US006969269B2

(12) United States Patent
Sakai

(10) Patent No.: US 6,969,269 B2
(45) Date of Patent: Nov. 29, 2005

(54) BATTERY CHARGER

(75) Inventor: Yoshihiro Sakai, Fukushima (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/973,435

(22) Filed: Oct. 27, 2004

(65) Prior Publication Data

US 2005/0106908 A1 May 19, 2005

(30) Foreign Application Priority Data

Nov. 14, 2003 (JP) ..... 2003-385289

(51) Int. Cl.[7] ..... H01R 13/44
(52) U.S. Cl. ..... 439/131; 439/638
(58) Field of Search ..... 439/131, 171–174, 439/956, 638

(56) References Cited

U.S. PATENT DOCUMENTS 5,220,152 A * 6/1993 Doran ..... 219/201
6,179,633 B1 * 1/2001 Inada ..... 439/131
6,641,412 B2 * 11/2003 Kitagawa et al. ..... 439/131
6,659,782 B2 * 12/2003 Wu ..... 439/131
6,722,900 B2 * 4/2004 Segawa et al. ..... 439/131
2004/0053536 A1 * 3/2004 Chen et al. ..... 439/638

* cited by examiner

*Primary Examiner*—Hien Vu
(74) *Attorney, Agent, or Firm*—Oblon, Spivak, McClelland, Maier & Neustadt, P.C.

(57) ABSTRACT

An AC adaptor has an AC plug having wider contact portions facilitating better contact despite the displacement. AC plug 3 of AC adaptor 3 has a pair of conductive blades 4, an end surface with the blades projecting with a substantially right angle, a first surface and a first rotary shaft on a first side surface. On a second side surface opposite to the first side surface, there are provided a second surface and a second rotary shaft. A first and second planar contact portions which are electrically connected respectively to a first and second conductive blades are configured respectively to project slightly from the surfaces of the first and second rotary shafts. On a circuit board in the case, there are provided conductive spring terminals 17 with projecting portions thereof making resilient contact with the first and second planar contact portions 15.

8 Claims, 6 Drawing Sheets

BATTERY CHARGER

CROSS REFERENCE TO RELATED APPLICATION

This application claims priority from Japanese Priority Application No. 2003-385289, filed on Nov. 14, 2003 with the Japanese Patent Office, the entire content of which is hereby incorporated by reference.

BACKGROUND OF THE INVENTION

1. Field of the Invention

The present invention relates to a battery charger, more specifically to a battery charger having a rotary AC plug which can be accommodated in a case of the main body.

2. Description of Related Art

In recent years, various types of portable machines including digital video cameras, digital still cameras and the like are well accepted by many generations and find wide applications. Power supplies for such portable machines are mostly batteries. In particular, in light of advanced battery technology and ever increasing users' conscious to recycling, many portable machines are designed to operate on rechargeable batteries (for example, lithium ion batteries).

In response to increased demands for such rechargeable batteries, many battery chargers for charging batteries by using an AC power supply are on the market.

There are conventional battery chargers such as one capable of accommodating an AC plug within the main body of the charger (see Patent Document 1) and one having contact members with which the AC plug and the main body of the charger make contact (see Patent Document 2). In the Patent Document 1, the AC plug rotates about rotary shafts extending through a support member of the AC plug for supporting a pair of electrically conductive blades and projects at 90 degrees with respect to the main body of the charger, thereby enabling the user to insert into a wall outlet of an AC power supply. Such rotation is oriented in the direction of the plate surface of the pair of conductive blades.

On the contrary, there is another type in which an AC plug is similarly constructed to project at 90 degrees from the charger main body by rotating about rotary shafts passing through a support portion for supporting the conductive blade, but rotating in the direction perpendicular to the plate surface of the pair of conductive blades (so-called lateral rotary type). In this specification, the mode in which the AC plug rotates laterally is referred to as the "lateral rotation".

An example of conventional battery chargers belonging to such type is shown in FIGS. 7A and 7B and FIG. 8. FIG. 7A shows the front view and FIG. 7B shows the plan view in the condition where the AC plug to be inserted into a wall outlet of the AC power supply is projecting at about 90 degrees from the case of the battery charger.

FIG. 7A shows the condition where the AC plug 51 having a pair of conductive blades 52, AC plug rotary shafts 53, and contact portions 54 for making electrical contact with the aforementioned conductive blades is projecting from a case 50 of the battery charger at substantially right angle. The AC plug 51 is able to rotate laterally about the AC plug rotary shafts 53 by about 90 degrees in the direction of an arrow d. Because of such rotation, it is constructed so that the AC plug 51 can be accommodated within the case 50. Disposed on the surface of the AC plug rotary shaft 53 are the contact portions 54 which are electrically connected to the respective conductive blades 52.

The aforementioned contact portions 54 are respectively disposed in such a manner to oppose to each other with the center point of the rotary shaft 53 of the AC plug between them near the outer circumferential surface of the circular rotary shaft 53 of the AC plug. Additionally, the contact portions 54 are contacting with respective conductive spring terminals 55 for making electrical connection therebetween under the condition as shown in FIG. 7A.

When the AC plug 51 is rotated at about 90 degrees in the direction of the arrow d, the portions of the rotary shaft 53 of the AC plug also rotate in the direction of the arrow d and the contact portions 54 disposed on the surface of the rotary shaft 53 of the AC plug also rotate in the direction of the arrow d, thereby separating the contact portions 54 from the respective conductive spring terminals 55 so as to maintain a constant distance.

The contacting condition between the contact portions 54 and the conductive spring terminals 55 is more clearly shown in FIG. 7B. Also formed is a cavity portion 56 acting as a space for accommodating the conductive blades 52 when the AC plug 51 is laterally rotated at about 90 degrees in the direction of the arrow d in FIG. 7A.

FIG. 8 shows the aforementioned AC plug 51 under the condition as shown in FIGS. 7A and 7B, i.e., a perspective view of the neighboring portion of the AC plug 51 when the conductive blades 52 are projecting at substantially right angle with respect to the case 50.

In this type of battery charger, as apparent by making reference particularly to FIG. 7B, the contact portions 54 for respective poles are disposed on the surface of the rotary shaft 53 of the AC plug at the same side.

[Patent Document 1] Japanese Patent Application Publication No.HEI 6-38388

[Patent Document 2] Japanese Utility Model Application Publication No. HEI 5-88152

SUMMARY OF THE INVENTION

However, in the conventional battery chargers, since two contact portions are disposed on the surface of one of the rotary shafts of the AC plug, it is required to separate the two contact portions at more than a predetermined distance in order to satisfy the requirements of safety regulations in foreign countries. According to UL [Underwriters Laboratories] 1310 that is the safety regulations in foreign countries, it is determined that the distance between the contact portions must be 6.4 mm or larger.

Moreover, there encounters another problem to increase the size of the rotary shafts of the AC plug and the conductive spring terminals due to increased distance between the two contact portions. As a result, a certain space is required at the periphery of the rotary shafts of the AC plug, thereby preventing miniaturization of the battery charger.

It is therefore an object of the present invention to provide a compact battery charger capable of constructing the peripheral portions of the rotary shafts of the AC plug with a smaller space while maintaining excellent connection.

The present invention is a battery charger having an AC plug for making connection to an AC power supply and for charging a battery by converting the AC power supply into a DC power supply, wherein the AC plug has a first conductive blade, a second conductive blade and a supporting portion for partly supporting the first conductive blade and the second conductive blade. By rotating the AC plug in the direction perpendicular to the plate surfaces of the first conductive blade and the second conductive blade, the AC plug is accommodated in a case of the battery charger or moved to the location projecting from the case of the battery charger. The supporting portion comprises an end surface from which a part of the first conductive blade and a part of the second conductive blade are projecting at substantially right angle, a first surface perpendicular to the end surface and defining a first side surface of the AC plug, a second surface to define a second side surface opposite to the first side surface, a first rotary shaft extending outwardly from the first surface, and a second rotary shaft extending outwardly from the second surface. A first planar contact portion electrically connected to the first conductive blade projects from the first rotary shaft and a second planar contact portion electrically connected to the second conductive blade projects from the second rotary shaft. A circuit board provided in the case is formed with a first conductive spring terminal and a second conductive spring terminal in which a projecting portion of the first conductive spring terminal resiliently contacts with the first planar contact portion, while a projecting portion of the second conductive spring terminal resiliently contacts with the second planar contact portion.

According to the present invention, since contact portions for conductive blades are disposed on the respective surfaces of the rotary shafts at both sides of the AC plug in such a manner to slightly extend therefrom, it is possible to provide a more compact battery charger by constructing to have a smaller space at peripheral portions of the rotary shafts of the AC plug. It is also possible to effectively prevent defective contact due to displacement of the conductive spring terminals and the like because the protruding portions of the conductive spring terminals and the planar contact portions of the conductive blades make contact and the contact portions are disposed over a wider area.

Moreover, since the particular construction of the present invention is capable of minimizing the conductive spring terminals, it is possible to gain a space for internal components. Also, since freedom with regard to the shape of the conductive spring terminals is increased, compact design of the battery charger can be further enhanced. Furthermore, since unnecessary confirmation in assembling stages can be eliminated, it is possible to reduce manufacturing cost.

Further features of the invention, and the advantages offered thereby, are explained in detail hereinafter, in reference to specific embodiments of the invention illustrated in the accompanying drawings.

DESCRIPTION OF THE PREFERRED EMBODIMENT

Figure 1A:
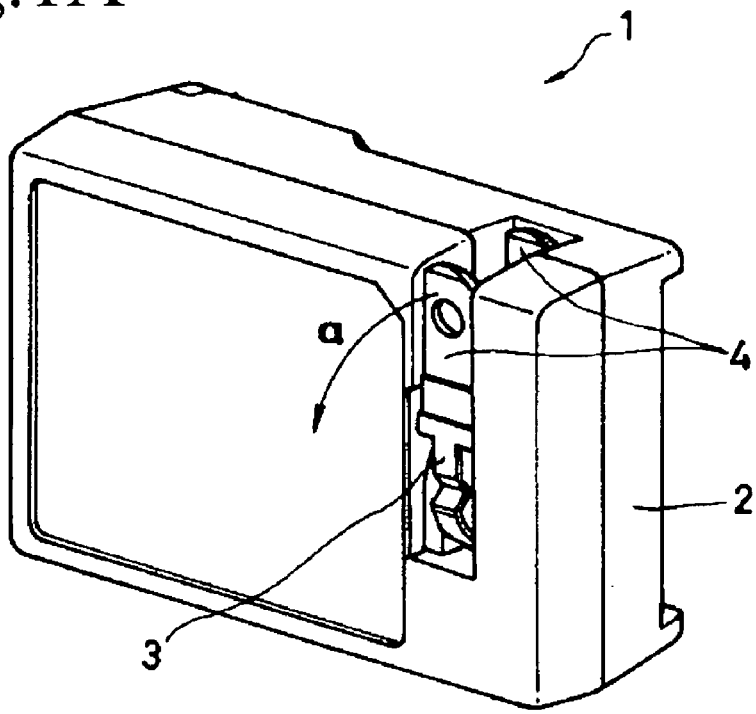
FIGS. 1A–1B are schematic illustrations of a battery charger according to an embodiment of the present invention.
Figure 1B:
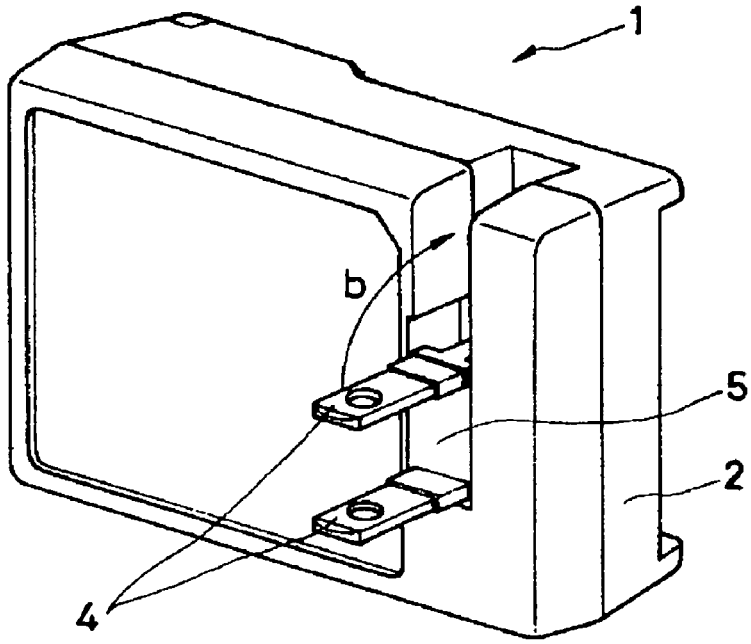

Now, a preferred embodiment of the present invention will be described hereunder by making reference to the accompanying drawings. FIGS. 1A and 1B are perspective views for illustrating an example of the battery charger according to embodiments of the present invention. FIG. 1A shows a condition where the AC plug 3 to be inserted into a wall outlet for an AC power source is accommodated inside the case 2 of the battery charger 1. The AC plug 3 has a pair of conductive blades 4 that project from the case 2 by being rotated at about 90 degrees in the direction of an arrow a (lateral rotation) about the rotary shafts of the AC plug 3. The battery charger is designed for charging, for example, a lithium ion battery to be used for a digital video camera, a digital still camera, or the like.

Shown in FIG. 1B is a condition where the AC plug 3 is rotated at about 90 degrees in the direction of the arrow a from the condition as shown in FIG. 1A so that the conductive blades 4 are projected at substantially right angle with respect to the side surface of the case 2. Under this condition, the conductive blades 4 can be inserted into a wall outlet for AC power source. The pair of the conductive blades 4 have one ends that are supported by, for example, an insulating plastic resin. These conductive blades 4 are supported at substantially right angle with respect to an end surface 5 that is a part of the aforementioned support portion and in parallel with each other. The battery charger 1 converts AC power supply that is derived by way of the conductive blades 4 into DC power supply for charging the battery. By rotating the AC plug 3 at substantially 90 degrees in the direction of an arrow b in FIG. 1B, the AC plug 3 is received in the case 2 to return the condition as shown in FIG. 1A.

Figure 2A:
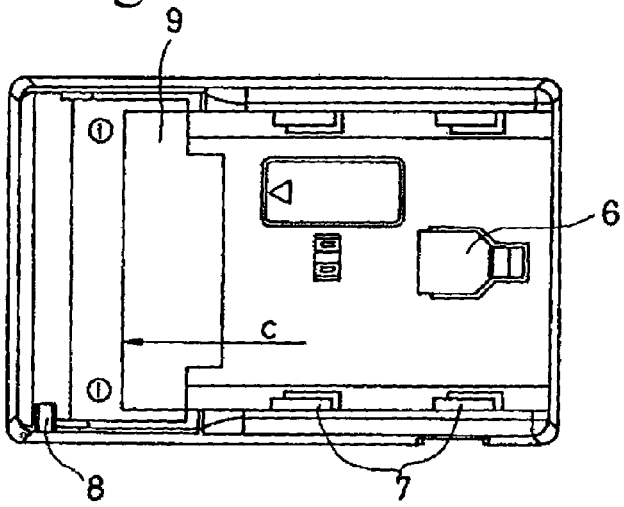
FIGS. 2A–2D are schematic illustrations of a battery charger viewed from different angles according to an embodiment of the present invention.
Figure 2B:
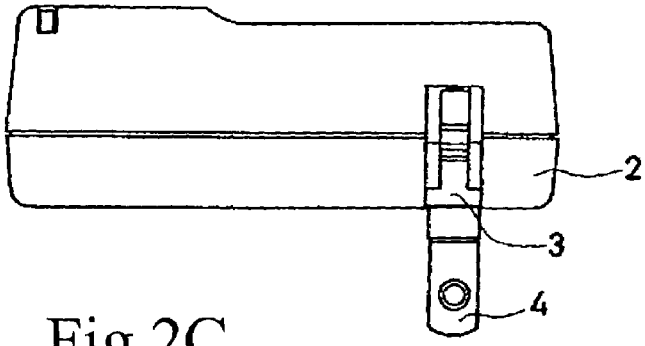
Figure 2D:
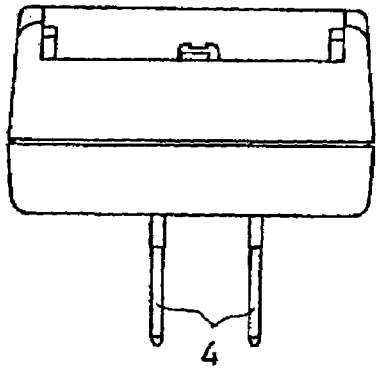
Figure 2C:
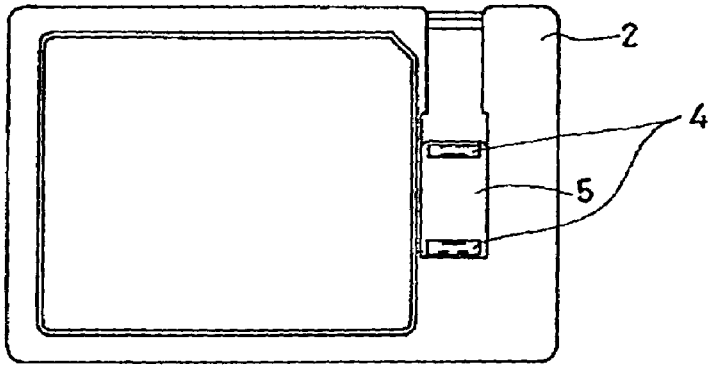

FIGS. 2A–2D show various views of the battery charger 1 with the AC plug 3 extending as shown in FIG. 1B and seen from different angles. FIG. 2A is a plan view of the battery charger 1, FIG. 2B is a front view of the battery charger 1, FIG. 2C is a bottom view of the battery charger 1 and FIG. 2D is a side view of the battery charger 1.

In the battery charger 1 in this particular embodiment, a battery to be charged is installed onto a channel portion at the upper side as shown in FIG. 2D. For installation, the battery is slid along the aforementioned channel portion in the direction of an arrow c as shown in FIG. 2A until it aligns with the head of the arrow c. Then, terminal contact portions inside a slide shutter 9 make electrical contact with the battery terminals and charging is carried out under such condition.

Other than the foregoing, shown in FIG. 2A are a claw 6 for locking the battery, key-like hold-down members 7 when sliding the battery and a charging lamp 8.

Figure 3A:
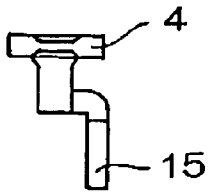
FIGS. 3A–3C are schematic illustrations of a conductive blade of an AC plug according to an embodiment of the present invention.
Figure 3B:
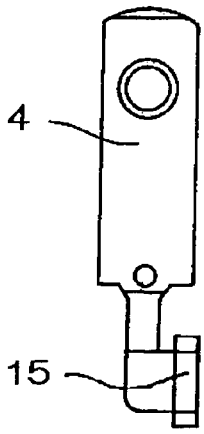
Figure 3C:
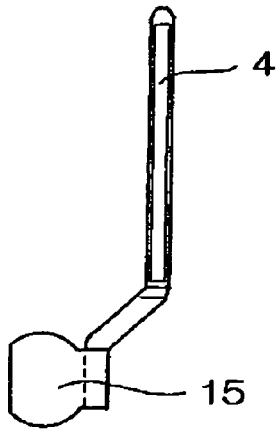

Now, the construction of the AC plug 3 will be described in greater detail. FIGS. 3A–3C are various views to show the construction of the conductive blade 4. FIG. 3A is a plan view of the conductive blade 4, FIG. 3B is a front view of the conductive blade 4 and FIG. 3C is a side view of the conductive blade 4.

As shown in FIG. 1, the AC plug 3 contains a pair of conductive blades 4 and the conductive blades 4 of the same shape can be used in the particular embodiment of present invention. As shown in FIG. 3B, one end of the conductive blades 4 has a planar surface of a constant width that is inserted into a wall outlet for AC power source [such portion is referred to an inserting portion below]. Width, thickness, length and the like of the inserting portion comply with a certain standards. The other end of the conductive blade 4 extends in an L-shape and the end portion thereof defines a planar contact portion 15. As will be described hereinafter, the planar contact portion 15 resiliently contacts with a projecting portion 19 of the conductive spring terminal 17 for supplying AC power to circuit portions on a circuit board.

As shown in FIG. 3A and FIG. 3C, the surface of the contact portion 15 is substantially vertical relationship with the plate surface of the inserting portion of the conductive blade 4. In particular, as apparent from FIG. 3C, a relatively narrow portion between them is bent at an angle so as to interconnect the two portions [and the portion is referred to narrow-down portion below].

Figure 4A:
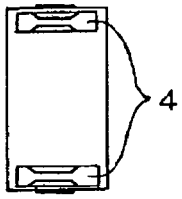
FIGS. 4A–4D are schematic illustrations showing the construction of an AC plug according to an embodiment of the present invention.
Figure 4B:
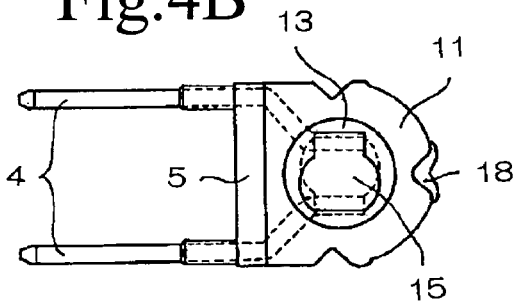
Figure 4C:
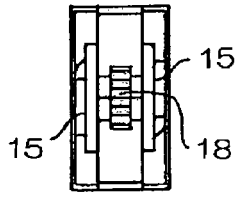
Figure 4D:
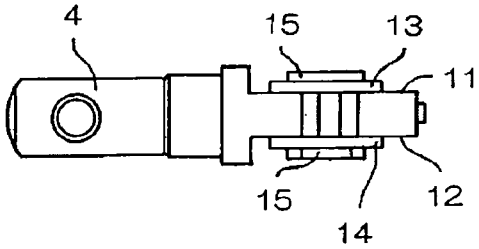

FIGS. 4A–4D are various views to show the construction of the AC plug 3. FIG. 4A is a left side view of the AC plug 3, FIG. 4B is a front view of the AC plug 3, FIG. 4C is a right side view of the AC plug 3 and FIG. 4D is a bottom view of the AC plug 3.

As shown in FIG. 4B and FIG. 4D, the AC plug 3 comprises a first rotary shaft 13 and a second rotary shaft 14 extending respectively from a first surface 11 and a second surface 12. These rotary shafts are supported by structures at the periphery of the AC plug accommodation portion in the case 2 of the battery charger 1 and act as rotary shafts at the time when the AC plug 3 extends from the case 2.

As apparent from FIG. 4B, the AC plug 3 includes a pair of conductive blades 4. Among other portions, primarily the narrow-down portions [the portions as shown by the dotted line in FIG. 4B] are supported by burying in, for example, an insulating plastic resin or the like in such a manner that the inserting portions are extending outwardly from the insulating plastic resin or the like. The contact portions are configured to have a relatively large surface that is substantially perpendicular to the planar surfaces of the inserting portions of the conductive blades 4 and slightly extend from the respective surfaces of the first rotary shaft 13 and the second rotary shaft 14. As a result, it is possible to provide the more compact battery charger by configuring the peripheral portions of the rotary shafts of the AC plug with minimum space.

The pair of conductive blades 4 approach to each other with minimum spacing at the locations where the contact portions 15 exit from the insulating plastic resin or the like. The approached portions are one ends of the aforementioned narrow-down portions that are connected to the contact portions 15. By taking the configuration to integrate with, for example, an insulating plastic resin as described hereinabove, the distance required by the UL1310 (the insulation distance within the plastic resin) can be reduced to 0.8 mm.

On the other hand, the inserting portions of the pair of the conductive blades 4 extend at substantially right angle with respect to the end surface 5 of the insulating plastic resin or the like and are held in parallel with each other as shown in FIG. 4A and FIG. 4B.

As shown in FIG. 4B, a notch for click mechanism 18 is also formed at the right end of the AC plug 3 and a claw to fit in the notch is formed in the case 2. Provision of such elements has a function to temporally support the AC plug 3 in such a manner that the AC plug 3 is in the condition to be accommodated in the case 2 of the battery charger 1 or the condition projecting from the case 2 of the battery charger 1.

Figure 5A:
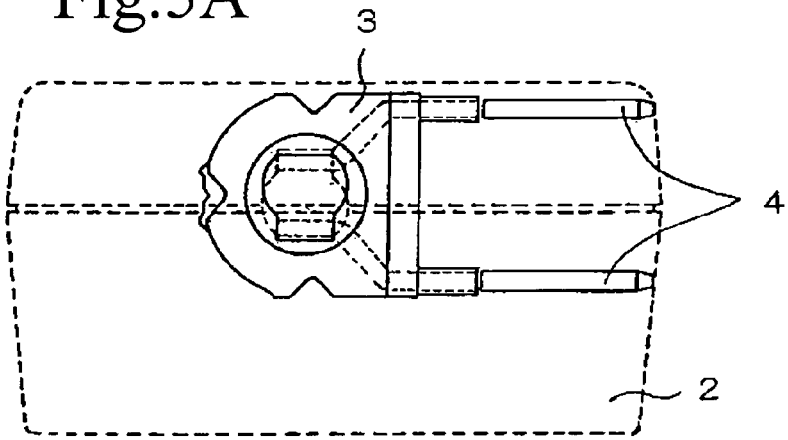
FIGS. 5A–5C are schematic illustration showing a battery charger incorporating an AC plug according to an embodiment of the present invention.
Figure 5B:
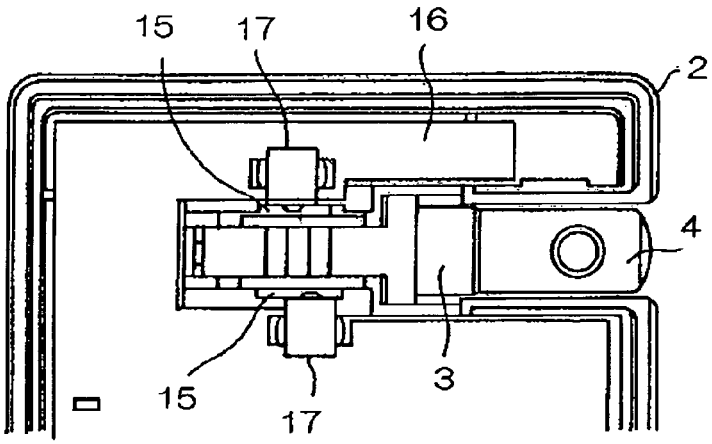
Figure 5C:
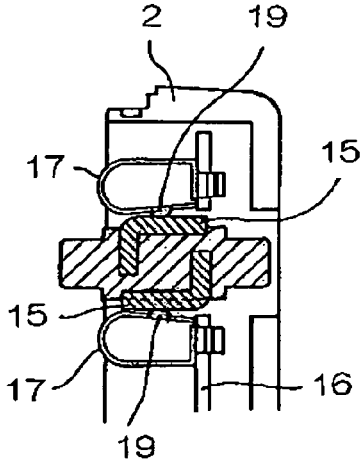

Now, reference is made to FIGS. 5A–5C to describe the positional relationship of the aforementioned AC plug 3, the case 2 of the battery charger 1 and the conductive spring terminals. FIGS. 5A–5C are various views to show the peripheral construction of the AC plug 3 and the case 2. FIG. 5A shows a condition where the AC plug 3 is accommodated in the battery charger 1, while FIG. 5B and FIG. 5C show how the pair of the contact portions 15 of the AC plug 3 make contact with the respective conductive spring terminals 17.

As will be understood by making reference also to FIG. 5B and FIG. 5C, the contact portion 15 of one of the conductive blades 4 contacts with the corresponding conductive spring terminal 17, while the other contact portion 15 similarly contacts with the other corresponding conductive spring terminal 17. Moreover, the conductive spring terminals 17 contact with respective contact portions 15 at the projecting portions 19. Although the AC plug 15 is shown in the condition where it is accommodated in the case of the battery charger 1 in this example, since the contact portions 15 are relatively large planar portions, similar contact as mentioned hereinabove can be achieved even in the condition where the AC plug 3 is extending at substantially right angle from the case 2 of the battery charger 1.

As shown in FIGS. 3A–3C, the contact portions 15 of the conductive blades 4 are constructed to slightly project from the surfaces of the first rotary shaft 13 and the second rotary shaft 14 of the AC plug 3. The contact portion 15 projecting from the surface of the first rotary shaft 13 is constructed to project from the surface of the first rotary shaft 13 in the range to include at least the trace of movement of the projecting portion 19 of the conductive spring terminal 17 due to rotation of the AC plug 3. Moreover, it is preferable that the contact portions 15 have certain play areas projecting outside the trace of movement of the projecting portions 19. Because of such configuration, it is possible to effectively prevent defective contact between the conductive spring terminal 17 and the contact portion 15 even if the conductive spring terminal 17 may have certain misalignment. Similarly, the contact portion 15 projecting form the surface of the second rotary shaft 14 is configured to project from the surface of the second rotary shaft 14 in a range to include at least the trace of movement of the projecting portion 19 on the conductive spring terminal 17 due to rotation of the AC plug 3.

Incidentally, as shown in FIG. 5C, AC power source is supplied to a circuit board 16 by way of the conductive blades 4, the contact portions 15 and the conductive spring terminals 17.

In accordance with the construction of the present invention, the pair of the contact portions 15 are disposed on the side surfaces on the opposite sides of the AC plug 3 and the conductive blades 4 are supported by an insulating plastic resin or the like at one ends of the narrow-down portions.

Figure 6A:
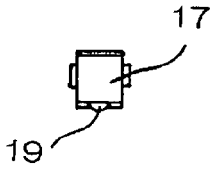
FIGS. 6A–6C are schematic illustrations showing the construction of a conductive spring terminal according to an embodiment of the present invention.
Figure 6B:
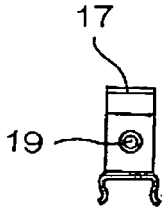
Figure 6C:
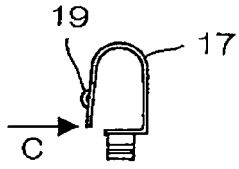
Figure 7A:
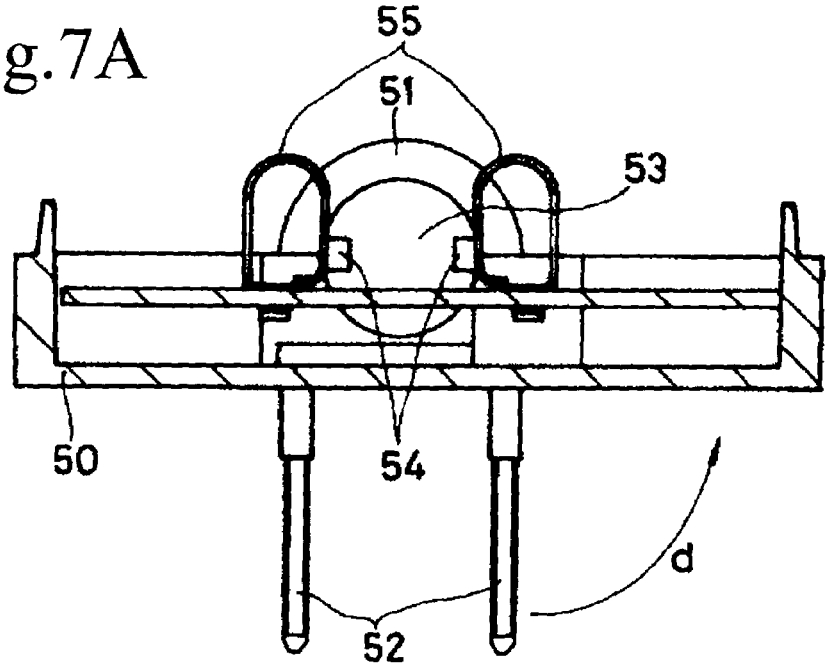
FIGS. 7A–7B are schematic illustrations showing the construction of a conventional battery charger with an AC plug.
Figure 7B:
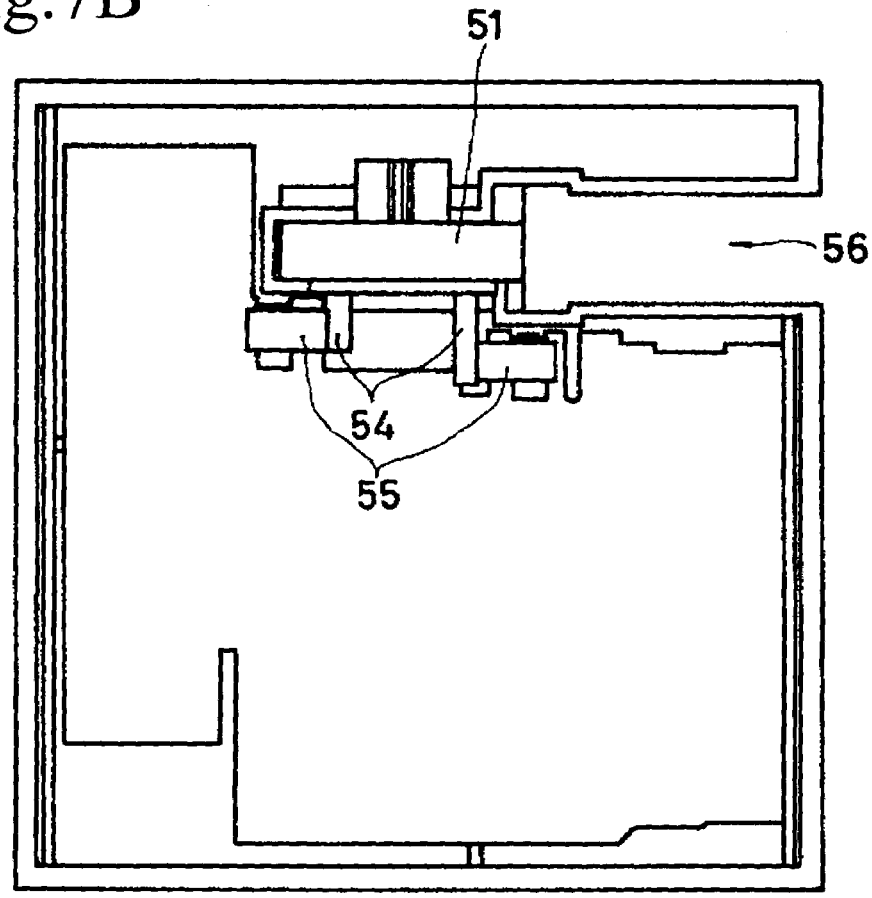
Figure 8:
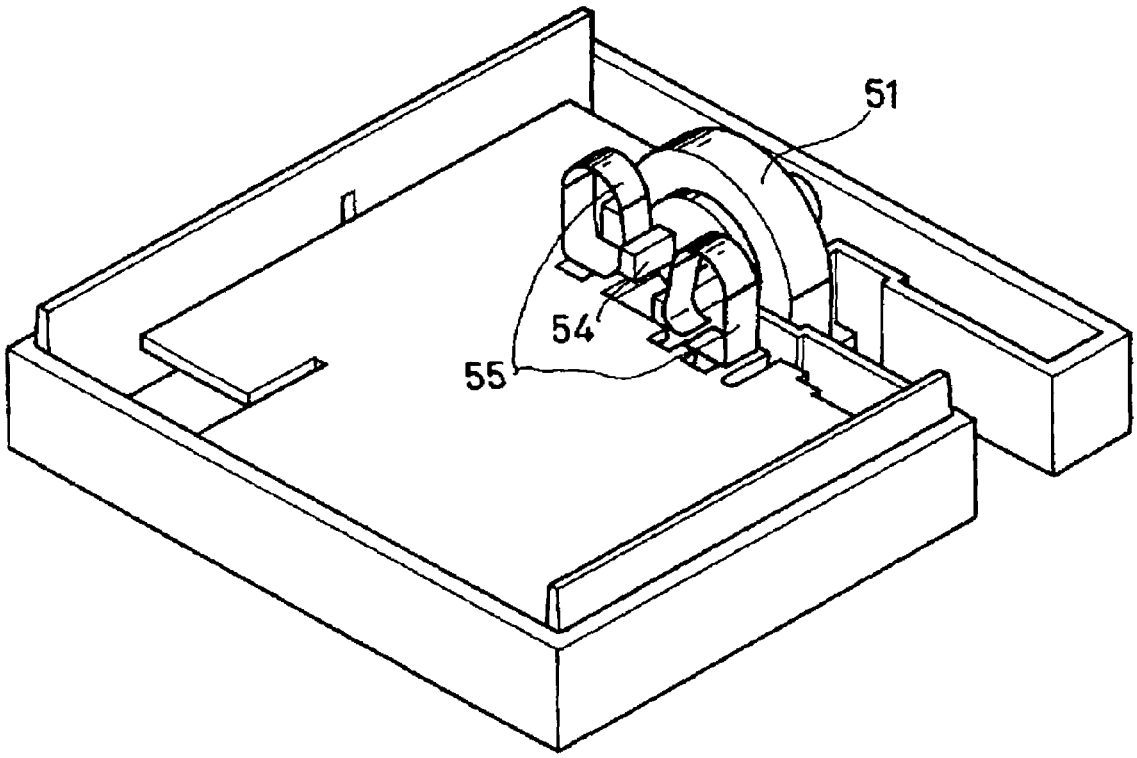
FIG. 8 is a perspective illustration of the construction of a conventional battery charger with an AC plug.

Now, the construction of the conductive spring terminal 17 will be described by making reference to FIGS. 6A–6C. Although the battery charger 1 has a pair of conductive spring terminals 17, they are basically the same type. FIG. 6A is a plan view of the conductive spring terminal 17, FIG. 6B is a front view of the conductive spring terminal 17 and FIG. 6C is a side view of the conductive spring terminal 17. The construction of the conductive spring terminal 17 is clearly shown, particularly in FIG. 6C. When a force is applied to the conductive spring terminal 17 in the direction of an arrow c, a reaction force is developed in the opposite direction to that direction. As a result, a resilient contact is established between the contact portion 15 or the corresponding conductive blade 4 and the conductive spring terminal 17.

The conductive spring terminals 17 contact with the contact portions 15 at the projecting portions 19 on the side surfaces of the spring that face the contact portions 15. By providing the sufficiently wide contact portions 15 for the possible trace of movement of the projection portions 19, it is possible to maintain good contact between the projection portions 19 and the contact portions 15 even if certain degree of misalignment may exist.

The presently disclosed embodiment is therefore considered in all respects to be illustrative, and not restrictive. The scope of the invention is indicated by the appended claims, rather than the foregoing description, and all changes that come within the meaning and range of equivalence thereof are intended to be embraced therein.

What is claimed is:

1. A battery charger having an AC plug for making connection to an AC power supply and for charging a battery by converting said AC power supply into a DC power supply, said battery charger comprising:

a slide shutter configured to slidably cover a charging terminal:

a claw configured to lock the battery in place so as to electrically contact said charging terminal;

a key-like hold-down member configured to guide the battery when the battery is slid in place; and wherein said AC plug has a first conductive blade, a second conductive blade and a supporting portion for partly supporting said first conductive blade and said second conductive blade, said AC plug is rotatable in a direction perpendicular to plate surfaces of said first conductive blade and said second conductive blade so as to accommodate said AC plug in a case of said battery charger when set in a first position and projecting from said case when set in a second position;

said supporting portion comprises an end surface from which a part of said first conductive blade and a part of said second conductive blade project at a substantially right angle, a first surface perpendicular to said end surface and defining a first side surface of said AC plug, a second surface to define a second side surface opposite to said first side surface, a first rotary shaft extending outwardly from said first surface, and a second rotary shaft extending outwardly from said second surface;

a first planar contact portion electrically connected to said first conductive blade projects from said first rotary shaft and a second planar contact portion electrically connected to said second conductive blade projects from said second rotary shaft; and a first conductive spring terminal and a second conductive spring terminal respectively having a projecting portion are provided for a circuit board in said case, while said projecting portion of said first conductive spring terminal resiliently contacts with said first planar contact portion and said projecting portion of said second conductive spring terminal resiliently contacts with said second planar contact portion.

2. The battery charger according to claim 1, wherein said first planar contact portion projects from said first rotary shaft in a range where said projecting portion of said first conductive spring terminal moves during rotation of said AC plug, and said second planar contact portion projects from said second rotary shaft in a range where said projecting portion of said second conductive spring terminal moves during rotation of said AC plug.

3. The battery charger according to claim 1, wherein a notch is provided for accommodating said supporting portion of said AC plug on a surface opposite to said end surface, and a claw to fit in said notch is provided for said case.

4. The battery charger according to claim 1, wherein said first and second planar contact portions extend in an L-shape from said first and second conductive blades, and the surfaces of said first and second planar portions are perpendicular to said first and second conductive blades.

5. The battery charger according to claim 1, wherein said AC plug includes said first and second conductive blades having respective ends spaced apart at a first distance so as to be received in an electrical socket and narrow-down portions at opposite ends thereof at a second distance smaller than the first distance and supported by burying in an insulating resin.

6. The battery charger according to claim 1, wherein said first and second planar contact portions are exposed to outside from said insulating resin.

7. The battery charger according to claim 1, wherein inserting portions of said first and second conductive blades extend at substantially right angle with respect to said end surface of said supporting portion, and are held in parallel with each other.

8. The battery charger according to claim 1, wherein said projecting portions are provided on the surface of said first and second conductive spring terminals respectively facing to said first and second planar contact portions.

* * * * *